US007378788B2

(12) United States Patent
Ando

(10) Patent No.: US 7,378,788 B2
(45) Date of Patent: May 27, 2008

(54) IMAGE DISPLAY APPARATUS

(75) Inventor: Yoichi Ando, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 568 days.

(21) Appl. No.: 11/157,819

(22) Filed: Jun. 22, 2005

(65) Prior Publication Data

US 2006/0001357 A1 Jan. 5, 2006

(30) Foreign Application Priority Data

Jun. 30, 2004 (JP) ..... 2004-193479

(51) Int. Cl.
*H01J 1/62* (2006.01)

(52) U.S. Cl. ..... 313/495; 313/292

(58) Field of Classification Search ..... 313/495, 313/238, 252, 292
See application file for complete search history.

(56) References Cited

U.S. PATENT DOCUMENTS 5,663,608 A * 9/1997 Jones et al. ..... 313/309
6,351,065 B2 * 2/2002 Yamazaki et al. ..... 313/497
6,517,399 B1 2/2003 Ito et al. ..... 445/24
6,840,832 B2 1/2005 Suzuki et al. ..... 445/5
7,034,449 B2 4/2006 Suzuki et al. ..... 313/495

FOREIGN PATENT DOCUMENTS

JP 10-302684 11/1998
JP 2000-164129 6/2000

* cited by examiner

*Primary Examiner*—Vip Patel
(74) *Attorney, Agent, or Firm*—Fitzpatrick, Cella, Harper & Scinto

(57) ABSTRACT

A display apparatus includes a vacuum case having a face plate and a rear plate with a conductive member on a surface, electrodes facing the conductive member in the vacuum case, and a spacer abutting one of the electrodes. The spacer has a concavity, and the interior surface of the concavity abuts the conductive member.

3 Claims, 4 Drawing Sheets

IMAGE DISPLAY APPARATUS

BACKGROUND OF THE INVENTION

1. Field of the Invention

The present invention relates to image display apparatuses including supportive structures to resist atmospheric pressure.

2. Description of the Related Art

Nowadays, image display apparatuses utilizing electron-emitting devices, especially, flat displays with a shallow depth, are regarded as replacements for cathode-ray tube displays because of their small sizes and low weights.

Such a flat display apparatus includes a rear plate, a face plate, and frame members that form an airtight case. The rear plate is provided with electron-emitting devices (i.e., a multi-electron-beam source) and the face plate is provided with a light-emitting member (i.e., a phosphor film) that emits light by electron-beam irradiation. The inside of the airtight case is held at a vacuum of about $10^{-6}$ Torr. Deformation or breakage of the rear plate and the face plate caused by the differential pressure between the inside and outside of the airtight case tends to occur with an increase in display area of the image display apparatus. Therefore, a means for preventing the deformation and breakage is required. Hence, glass plates (called spacers or ribs) for supporting atmospheric pressure are provided in the airtight case. Consequently, the inside of the airtight case is held at a high vacuum while the distance between the rear plate and the face plate usually ranges from under a millimeter to several millimeters.

It is necessary that the spacers do not significantly affect the electron trajectories between the rear plate and the face plate. However, the spacers affect electric fields near the spacers to bring the electric fields into static changes or dynamic changes caused by charge-up, and these changes in the electric fields lead to changes in electron trajectories. Charge-up of the spacers is assumed to occur because some of the electrons emitted from the electron source or electrons reflected by the face plate enter the spacers and generated secondary electrons are emitted from the spacers; or ions generated by collision of electrons attach to the surfaces of the spacers.

Since positively charged spacers attract electrons traveling near the spacers, displayed images are distorted near the spacers. The effect of charge-up increases with the distance between the rear plate and the face plate.

In order to avoid charge-up, the surfaces of the spacers are generally made conductive. As a result, a small amount of current can flow in the spacers to remove the charge.

Japanese Patent Laid-Open No. 10-302684 discloses such a display apparatus having a structure for improving the electrical connection and the alignment of the spacers and the rear plate; i.e., wiring electrodes on the rear plate are provided with grooves and the spacers abut the grooves.

However, the spacer disclosed in the above-mentioned patent document needs additional improvement in terms of withstand voltage of the spacers.

In the above-mentioned patent document, the grooves are provided in wiring for readily improving the assembly precision. The present invention provides a structure different from such a structure, in order to improve the assembly precision and also improve the withstand voltage of the spacers by a novel technology.

SUMMARY OF THE INVENTION

The above-mentioned problems can be solved by the present invention. The present invention provides display apparatuses each including a vacuum case having a face plate and a rear plate with a conductive member on a surface, electrodes facing the conductive member in the vacuum case, and a spacer abutting both the conductive member and the electrodes. The spacer has a concavity, and the interior surface of the concavity abuts the conductive member.

Further features and advantages of the present invention will become apparent from the following description of exemplary embodiments with reference to the attached drawings.

DESCRIPTION OF THE EMBODIMENTS

The present invention will now be described with reference to the drawings.

Figure 2:
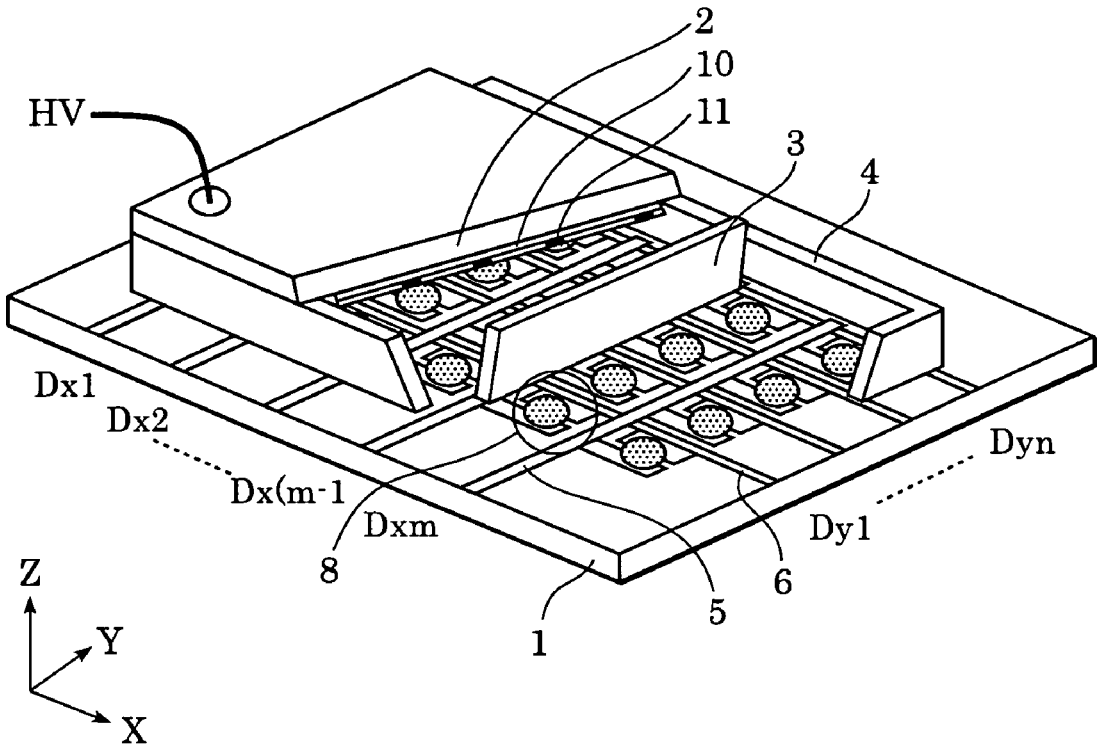
FIG. 2 is a partially cut-away perspective view of an image forming device according to the present invention.

FIG. 2 is a partially cut-away perspective view of a display panel of an image forming apparatus according to a first embodiment of the present invention.

With reference to FIG. 2, the display panel according to the first embodiment includes a first substrate functioning as a rear plate 1, a second substrate functioning as a face plate 2, a plate-shaped spacer 3, and side walls 4. The rear plate 1 and the face plate 2 are disposed so as to oppose each other with a certain spacing therebetween. The spacer 3 is disposed between the rear plate 1 and the face plate 2. The rear plate 1 and the face plate 2 are sealed with the side walls 4 to maintain the inside of the panel at a vacuum.

The rear plate 1 is provided with row wiring electrodes 5, column wiring electrodes 6, insulating layers 7 (see FIG. 1) positioned between the row and column wiring electrodes, and electron-emitting devices 8.

The electron-emitting devices 8 shown in FIG. 2 are surface-conduction electron-emitting devices each including a conductive film connected to a pair of device electrodes. The conductive film has an electron emitting portion. In this embodiment, a multi-electron-beam source is prepared by arranging N×M surface-conduction electron-emitting devices in the form of a matrix to be connected to M row wiring electrodes 5 disposed at a regular pitch and N column wiring electrodes 6 disposed at a regular pitch. The row wiring electrodes 5 are placed on the column wiring electrodes 6 via insulating layers 7. The row wiring electrodes 5 are supplied with scanning signals through projecting terminals Dx1 to Dxm, and the column wiring electrodes 6 are supplied with modulating signals (image signals) through projecting terminals Dy1 to Dyn.

The row wiring electrodes 5 and the column wiring electrodes 6 can be formed by the application of a silver paste by screen printing, or formed by a photolithographic process.

Various conductive materials in addition to the silver paste can be used as constituent materials for the row wiring electrodes 5 and column wiring electrodes 6. For example, in screen printing, a mixture of metal and a glass paste can be used as an application material for the row wiring electrodes 5 and the column wiring electrodes 6. When the row wiring electrodes 5 and the column wiring electrodes 6 are formed by metal deposition, plating bath composition can be used.

The bottom face of the face plate 2 (i.e., the face facing the rear plate 1) is provided with a phosphor film 10. Since the display panel according to this embodiment is a color display, the phosphor film 10 is separated into three primary colors of red, green, and blue. For example, the three colors are arranged in a stripelike configuration and a black conductive material (black stripes) is provided between the stripes of each color phosphor. The black conductive material can compensate for color shifting caused by small positional inaccuracies in electron beam irradiation, avoid a decrease in contrast by preventing reflection of outside light, and prevent the phosphor film from being charged up by the electron beam. An example of the black conductive material is a material consisting chiefly of graphite, but any material that can achieve the above-mentioned functions of the black conductive material can be used. The three primary colors of the phosphors can be arranged in a deltoid configuration or other configurations in addition to the stripelike configuration.

The surface of the phosphor film 10 is provided with metal backing 11 (accelerating electrodes), which is a conductive material provided on the face plate 2. A high voltage is applied to the metal backing 11 from a high-voltage terminal Hv so that the metal backing 11 is maintained at a potential higher than that of the row wiring electrodes 5. Thus, electrons from the electron emitting devices 8 are accelerated and drawn by the metal backing 11. In the display panel using the surface-conduction electron-emitting devices, like in this embodiment, a potential difference of about 5 to 20 KV is generally formed between the row wiring electrodes 5 and the metal backing 11.

The plate-shaped spacer 3 is provided on the row wiring electrode 5 so as to be parallel to the row wiring electrode 5 and is fixed on the rear plate 1 at both ends. The shape of the spacer 3 may be a cylindrical column or a rectangular column, in addition to the plate shape.

When the plate-shaped spacers are used, the number of the spacers can be reduced compared with that in the case of cylindrical spacers. Therefore, the plate-shaped spacer is advantageous in terms of cost.

The spacer 3 has a thickness of about 0.1 to 0.5 mm and a height of about 1 to 5 mm. In particular, a thickness of 0.15 to 0.3 mm and a height of 1.5 to 3 mm are preferably used. This is because conflicting requirements are balanced by such sizes; i.e., the requirement for a decrease in size of the spacer corresponding to a pixel pitch from the viewpoint of high image resolution and the requirement for an increase in size of the spacer from the viewpoint of processability of the spacer.

In general, a plurality of spacers 3 is disposed at a regular pitch so that the display panel has sufficient strength to resist atmospheric pressure. The spacers 3 are disposed between the rear plate 1 and the face plate 2. The rear plate 1 is provided with the electron emitting devices 8 and the row wiring electrodes 5 and the column wiring electrodes 6 for driving the electron emitting devices 8. The face plate 2 is provided with the phosphor film 10 and the metal backing 11. The top and bottom faces of each spacer 3 come into contact with the metal backing 11 and the row wiring electrode 5, respectively, by pressure. The side walls 4 are disposed between the rear plate 1 and the face plate 2 at the peripheries of these plates. The connecting portions of the side walls 4 with the rear plate 1 and the face plate 2 are sealed with frit glass or the like.

Figure 1:
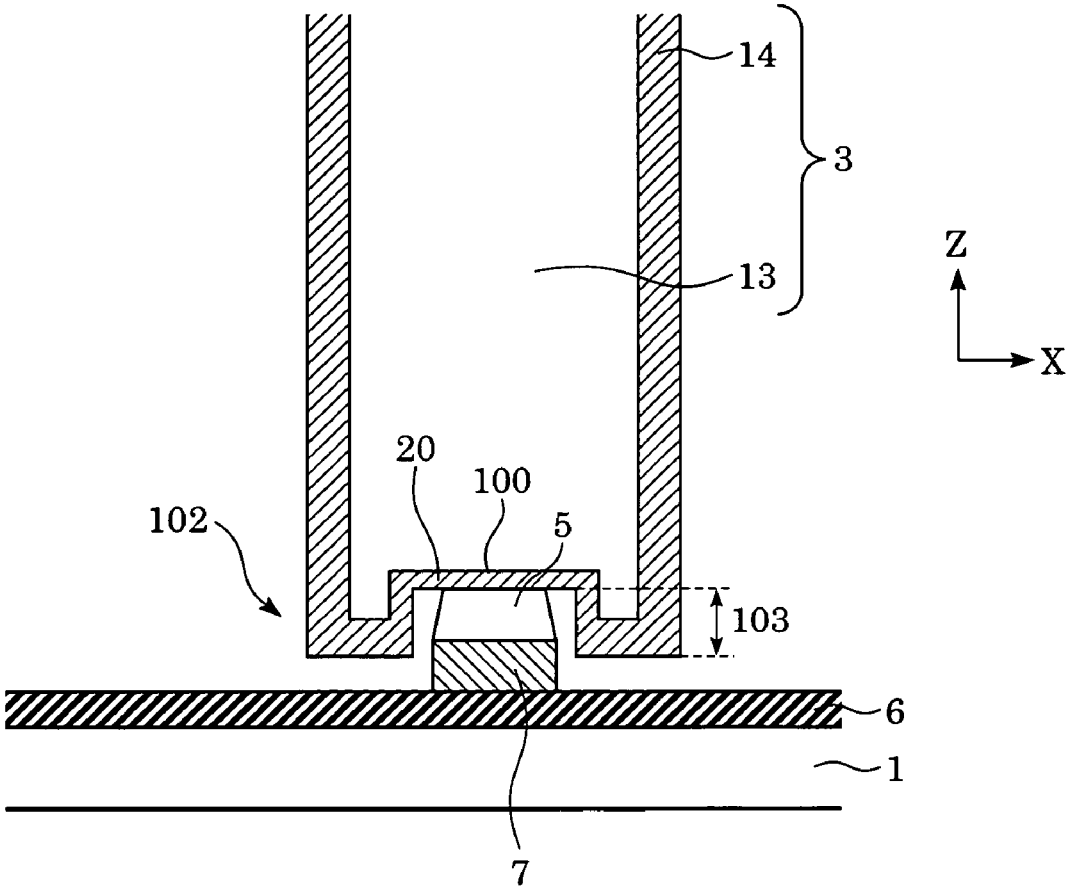
FIG. 1 is a partial cross-sectional view in the longitudinal direction of a spacer according to a first embodiment.

The spacer 3 has sufficient insulation to resist the high potential applied between the metal backing 11 on the face plate 2 and the row wiring electrode 5 or the column wiring electrode 6 on the rear plate 1. The spacer 3 may have some conductivity for preventing the surface from being charged up. The spacer 3 is composed of a substrate of an insulating material or is composed of a substrate having a highly resistive film coating the surface of the substrate. The spacer composed of the substrate and the resistive film is more suitable than that of the substrate only because of its high withstand-voltage. FIG. 1 illustrates a partial cross-section of the spacer 3 at a portion near the rear plate. The spacer is composed of a substrate 13 of an insulating material and a highly resistive film 14 coating the surface of the substrate 13.

As shown in FIG. 1, the abutting portion of the spacer 3 on the electrode includes an approximately rectangular concavity 100. The row wiring electrode 5 on the rear plate 1 has a width smaller than the thickness of the spacer 3 and abuts the concavity 100 of the spacer 3. The row wiring electrode 5 fits into the rectangular concavity 100 of the spacer 3 and facilitates assembling by functioning as a guide. The electrons from the electron emitting devices 8 have low kinetic energy near the rear plate 1 and the electron trajectories are thus readily affected by electric fields: therefore, precise alignment of the rear plate 1 and the spacer 3 is important. According to the present invention, since the spacer 3 is precisely arranged with respect to the rear plate 1, electric field disturbance near the electron-emitting devices 8 caused by misalignment of the spacer 3 is suppressed.

Figure 4:
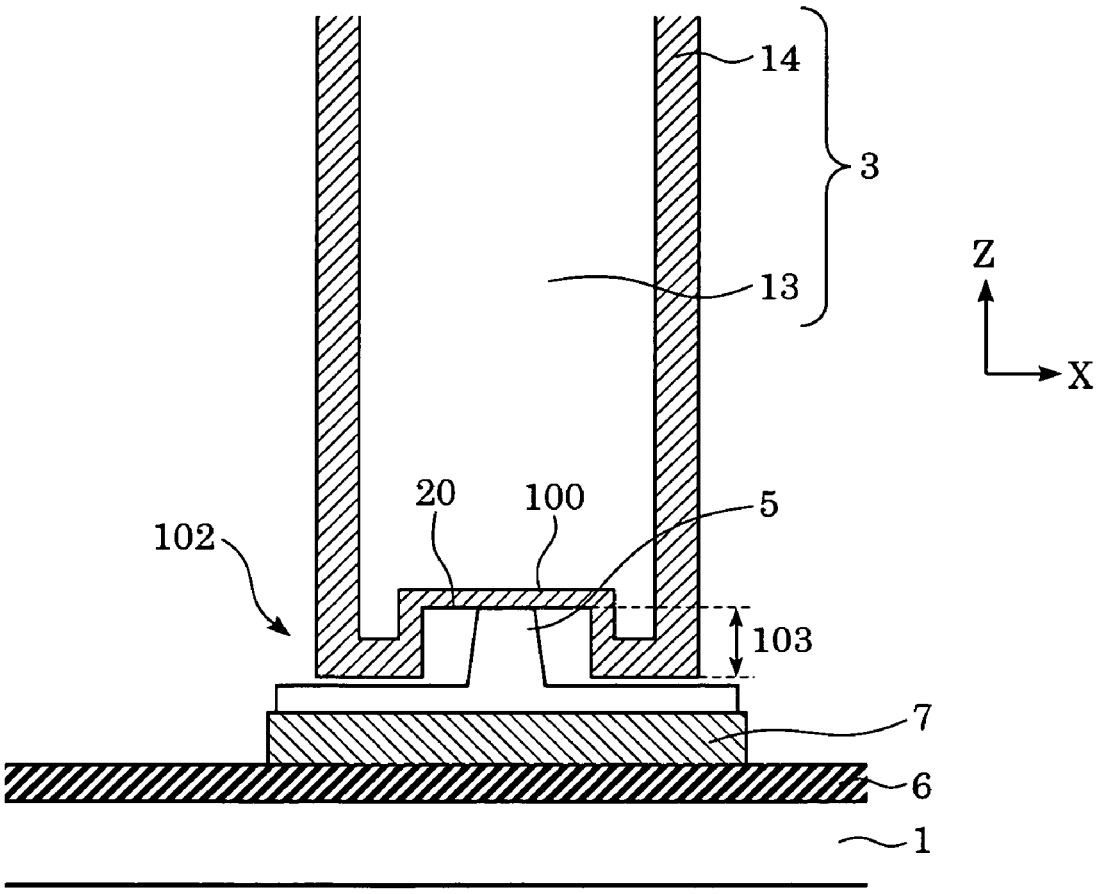
FIG. 4 is a partial cross-sectional view in the longitudinal direction of another spacer according to the first embodiment.

The row wiring electrode 5 may have a projection (shown in FIG. 4). In such a row wiring electrode, the projection has a width smaller than the thickness of the spacer 3, and the row wiring electrode 5 may have a width larger than the thickness of the spacer 3.

However, the row wiring electrode 5 having a width smaller than the thickness of the spacer 3 can be used from the viewpoint of manufacturing costs.

A V-shaped or arc-shaped concavity can also improve assembly precision by utilizing the force of atmospheric pressure.

However, a rectangular concavity is superior to the V-shaped or arc-shaped concavity because of its stable resistance to atmospheric pressure.

It is reported that a triple junction is apt to cause discharging by a concentrated electric field; therefore, improvement of the triple junction near the rear plate is also very important. According to the present invention, since the concavity is provided in the spacer and not in the wiring on the rear plate, the triple junction 20 is concealed from an anode on the face plate and is also shielded by the concavity of the spacer. As a result, electric discharge is reliably prevented.

The depth 103 of the concavity ranges from several micrometers to several hundred micrometers. As the depth 103 becomes deeper, the withstand voltage is improved and the ease of assembly increases. However, a deep concavity cannot be readily formed. Generally, a concavity has a depth of 10 to 100 μm.

The spacer 3 can be formed by cutting, drawing (see Japanese Patent Laid-Open No. 2000-164129), or the like. A highly precise shape can be formed by the drawing process with relatively little effort.

Examples of the constituent material for the substrate 13 of the spacer 3 include silica glass, glass containing impurities such as sodium at a reduced concentration, soda-lime glass, and ceramics such as alumina. The constituent material for the substrate 13 has a coefficient of thermal expansion the same or similar to that of the constituent material for the rear plate 1 or the face plate 2.

A current flows in the highly resistive film 14 coating the surface of the spacer 3. The amount of current is calculated by dividing an acceleration voltage Va applied to the metal backing 11 (i.e., the higher potential side) by the resistance of the highly resistive film 14. This current prevents the surface of the spacer 3 from being charged up. Therefore, the resistance of the highly resistive film 14 is defined in a range desirable for preventing charging and decreasing the power consumption. The sheet resistance of the highly resistive film 14 is preferably $10^{14}$ Ω/□ or less, more preferably $10^{12}$ Ω/□ or less, and most preferably $10^{11}$ Ω/□ or less, from the viewpoint of prevention of charge-up. Though the lower limit of the sheet resistance of the highly resistive film 14 depends on the shape of the spacer 3 and the voltage applied to the spacer 3, it is preferably $10^5$ Ω/□ or more, and more preferably $10^7$ Ω/□ or more, from the viewpoint of reduction in power consumption.

The thickness of the highly resistive film 14 is influenced by the surface energy of a material for the highly resistive film 14, adhesion between the highly resistive film 14 and the substrate 13, and temperature of the substrate 13. The highly resistive film 14 having a thickness of 10 nm or less is generally formed in an island shape, so that the resistance is unstable and reproducibility is poor. Conversely, in the highly resistive film 14 having a thickness of 1 μm or more, the film easily peels off because its membrane stress is large, and the productivity is low because the film formation takes a long period of time. Therefore, the thickness of the highly resistive film 14 disposed on the substrate 13 ranges from 10 nm to 1 μm, more preferably from 50 to 500 nm. The sheet resistance is defined by ρ/t (ρ: specific resistance, t: thickness of the film). The specific resistance ρ of the highly resistive film 14 ranges from 0.1 Ωcm to $10^8$ Ωcm, and more preferably ranges from $10^2$ to $10^6$ Ωcm, in order to achieve a preferable range of sheet resistance and film thickness.

The highly resistive film 14 can be composed of a metal oxide such as oxide of chromium, nickel, or copper. Since these oxides have a relatively low secondary-electron emission efficiency, the spacer 3 is hardly charged, regardless of collision of electrons from the electron emitting devices 8. Carbon also has a low secondary-electron emission efficiency and can be used as the highly resistive film 14 as well as the metal oxides. In particular, amorphous carbon has a high resistance. Therefore, appropriate surface resistance for the spacer 3 can be readily achieved by using amorphous carbon.

The resistance of nitrides of transition metals and germanium can be controlled in a broad range from highly conductive to insulating by adjusting the composition of the transition metal. Furthermore, nitrides of transition metals and germanium have a stable resistance and scarcely change their resistance during manufacturing of the display panels. Therefore, nitrides of transition metals and germanium are suitable for the highly resistive film 14. Examples of the transition metals include titanium, chromium, tantalum, and tungsten.

The nitride films can be formed under nitrogen atmosphere by a thin-film forming process such as sputtering, electron-beam evaporation, ion plating, or ion-assisted evaporation. The metal oxide films can be formed under oxygen atmosphere by a thin-film forming process. The metal oxide films can also be formed by chemical vapor deposition or alkoxide coating. The carbon films can be formed by evaporation, sputtering, chemical vapor deposition, or plasma chemical vapor deposition. Especially, the amorphous carbon films can be obtained by forming the films in a gas atmosphere containing hydrogen or in a hydrocarbon gas.

EXAMPLES

The present invention will now be described in detail with reference to examples.

Example 1

Preparation of Spacer

The substrate 13 of the spacer 3 was prepared with PD200 (Asahi Glass Company). A rectangular concavity was formed on PD200 (base material) by cutting. Then the base material was formed by drawing into a long square rod of cross-section 2 mm×0.25 mm, and then cut as required. The concavity had a depth of 20 μm and a width of 110 μm.

The highly resistive film 14 was formed by simultaneously sputtering with a tungsten target and a germanium target on the substrate 13 in a nitrogen gas atmosphere. The substrate 13 of the spacer 3 was rotated during the sputtering process so that the substrate 13 was uniformly coated with the highly resistive film 14 of tungsten/germanium nitride compound (WGeN). The highly resistive film 14 had a thickness of 200 nm and a sheet resistance of $2.5\times10^{12}$ Ω/□.

Preparation of Rear Plate

Next, the rear plate for disposing the spacer and a method for assembling the rear plate and the spacer will be described. A plurality of surface-conduction electron-emitting devices was formed on the rear plate so as to form electron source wiring in the form of a matrix. The steps in the preparation process will now be described.

The rear plate 1 was prepared by forming a silicon dioxide ($SiO_2$) layer having a thickness of 0.5 μm on a surface of a washed soda-lime glass by sputtering. A plurality of pairs of device electrodes for the surface-conduction electron-emitting devices were formed by laminating titanium and nickel on the rear plate 1 by sputtering and photolithography. The titanium layer had a thickness of 5 nm and the nickel layer had a thickness of 100 nm. The distance between the device electrodes was 2 μm.

The column wiring electrodes 6 were formed by printing a silver (Ag) paste in a predetermined pattern and then firing at 480° C. The column wiring electrodes 6 extended to the outside of the electron-source area and formed the electron-source driving wiring Dyn shown in FIG. 2. The column wiring electrodes 6 had a width of 100 μm and a thickness of about 10 μm.

The insulating layers 7 were formed by printing a lead oxide (PbO) paste containing a glass binder. The insulating layers 7 formed insulation between the column wiring electrodes 6 and the row wiring electrodes 5 described below. The insulating layers 7 had a thickness of about 20 μm.

The row wiring electrodes 5 were formed on the insulating layers 7.

The process for forming the row wiring electrodes 5 is the same as that of the column wiring electrodes 6. The row wiring electrodes 5 had a width of 100 μm and a thickness of about 10 μm. Next, a conductive film of fine-grained palladium oxide (PdO) was formed between each pair of device electrodes by photolithography as follows: forming a chromium (Cr) film on the rear plate 1 having the column wiring electrodes 6 and the row wiring electrodes 5 by sputtering; forming an aperture corresponding to the shape of the conductive film in the Cr film; applying a solution of an organic palladium compound (ccp-4230: Okuno Chemical Industries Co., Ltd) and firing at 300° C. for 12 minutes in air to form a fine-grained PdO film; removing the Cr film by wet etching; and forming the conductive film in the desired pattern by lift-off.

Then, an antistatic film (not shown) was formed all over the rear plate 1 by spraying an organic solvent dispersing a carbon material or conductive ultrafine particles chiefly composed of tin oxide or chromium oxide and firing at 380° C. for 10 minutes. The antistatic film had a thickness of 30 nm and a sheet resistance of $10^{10}$ Ω/□.

The spacer 3 was disposed on the rear plate 1 so that the concavity of the spacer 3 fits with the corresponding row wiring electrode 5 on the rear plate 1. Then, the face plate 2 shown in FIG. 1 was disposed so as to adjust the position with respect to the rear plate 1 provided with the spacer 3. The face plate 2 and the rear plate 1 were sealed to form a display panel for a display apparatus.

In such a display apparatus, the assembly of the spacer was easy and no discharge was observed by displaying images using a high applied voltage, such as 10 KV. This condition is suitable for this example, but can be changed corresponding to the panel structure.

Example 2

Figure 3:
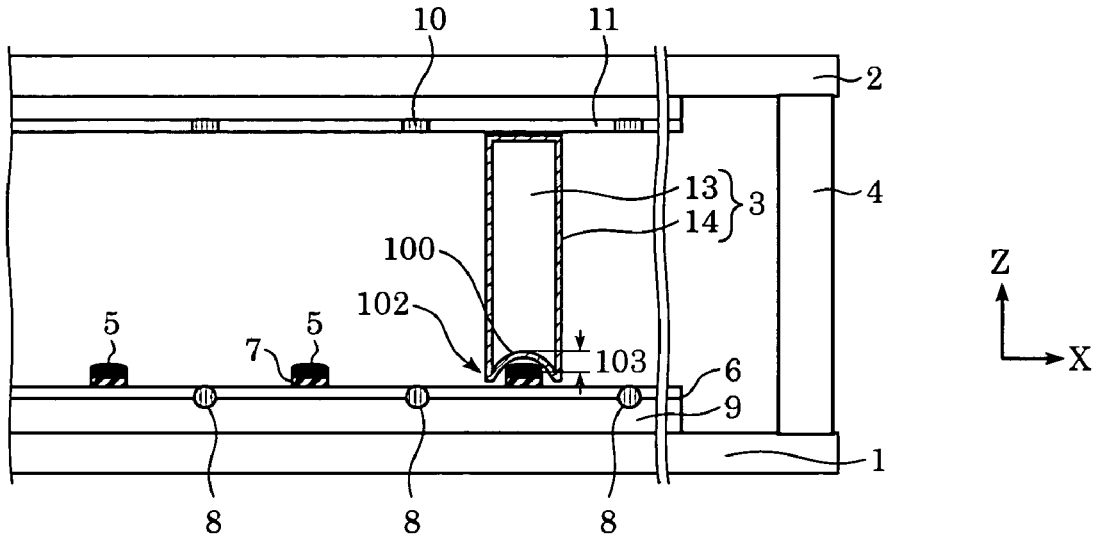
FIG. 3 is a partial cross-sectional view in the longitudinal direction of a spacer according to a second embodiment.

In EXAMPLE 2, a display apparatus was prepared by the same process as that in EXAMPLE 1 except that the spacer 3 has a concavity shaped like a circular arc and an electron-source substrate 9 is provided on the rear plate 1. The concavity had a depth of 20 μm. The structure is shown in FIG. 3. Since the process for forming the electron source and the process for forming the vacuum case can be performed independently by preparing the electron source substrate 9, the display apparatus can be manufactured in a reduced period of time.

In the display apparatus prepared in EXAMPLE 2, like EXAMPLE 1, the assembly precision of the spacer was good and no discharge was observed by displaying images using a high applied voltage, such as 10 KV.

According to the present invention, the alignment between the spacer and the electrode is improved and the withstand voltage is also improved.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-193479 filed Jun. 30th, 2004, which is hereby incorporated by reference herein.

What is claimed is:

1. A display apparatus comprising:

a vacuum case including a face plate and a rear plate having a conductive member on a surface;

an electrode facing the conductive member in the vacuum case; and a spacer abutting both the conductive member and the electrode, wherein the spacer has a concavity and the interior surface of the concavity abuts the conductive member.

2. The display apparatus according to claim 1, wherein the spacer is resistive and is electrically connected to the conductive member and one of the electrodes.

3. The display apparatus according to claim 1, wherein the conductive member has a projection and the concavity of the spacer fits with the projection.

* * * * *